US006125832A

United States Patent [19]

Toyohara et al.

[11] Patent Number: 6,125,832

[45] Date of Patent: Oct. 3, 2000

[54] ENGINE FUEL SUPPLY APPARATUS

[75] Inventors: Masahiro Toyohara, Hitachiota; Takeshi Atago; Toshio Hori, both of Hitachinaka, all of Japan

[73] Assignees: Hitachi, Ltd., Tokyo; Hitachi Car Engineering Co., Ltd., Hitachinaka, both of Japan

[21] Appl. No.: 09/220,800

[22] Filed: Dec. 28, 1998

[30] Foreign Application Priority Data

Dec. 25, 1997 [JP] Japan ..... 9-357694

[51] Int. Cl.[7] ..... F02M 37/04; F02D 41/00

[52] U.S. Cl. ..... 123/690; 123/479; 123/502

[58] Field of Search ..... 123/690, 497, 123/494, 679, 694, 695, 696, 502, 479, 480

[56] References Cited

U.S. PATENT DOCUMENTS 5,181,499 1/1993 Kayanuma ..... 123/690

5,609,140 3/1997 Kramer et al. ..... 123/497

5,947,098 9/1999 Hosokawa et al. ..... 123/679

FOREIGN PATENT DOCUMENTS 9-119335 5/1997 Japan .

*Primary Examiner*—Henry C. Yuen

*Assistant Examiner*—Hieu T. Vo

*Attorney, Agent, or Firm*—Evenson, McKeown, Edwards & Lenahan, P.L.L.C.

[57] ABSTRACT

An engine fuel supply apparatus is provided with an accident judging device for effecting accident judgement in a fuel control system under the conditions that the fuel pressure regulator driver is subjected to feedback control of the fuel pressure, and that there is a change in the fuel pressure and the change continues for a predetermined time of period within a set time range.

10 Claims, 10 Drawing Sheets

ENGINE FUEL SUPPLY APPARATUS

BACKGROUND OF THE INVENTION

The present invention relates to a fuel supply apparatus of an engine and, more particularly, to an engine fuel supply apparatus provided with a fuel supply system for pressurizing and delivering fuel to be injected by an injector of a direct injection engine.

A fuel supply control apparatus of an engine in which abnormality of fuel pressure is detected without use of feedback control signals and a suitable care is taken is disclosed in JP A 9-119335. That is, the JP A 9-119335 discloses an engine fuel supply control apparatus which is characterized by comprising a high pressure fuel supply system for pressurizing and delivering fuel to be injected by an injector into a direct injection gasoline engine, an engine revelational speed sensor, an alarm, a fuel pressure sensor provided in the high pressure fuel supply system and sensing fuel pressure and a controller for energizing the alarm when the fuel pressure is above an upper limit value or below a lower limit value which are set corresponding to the engine revelational speed, and further it discloses an engine fuel supply control apparatus which is characterized in that an electromagnetic valve is provided in the high pressure fuel supply system and the controller controls the electromagnetic valve so as to close when the fuel pressure is below the lower limit value.

Only detection of the condition that the pressure in a high pressure pump abnormally increased or decreased may cause an erroneous judgement due to such an instant change in fuel pressure as does not really reach a region (hereunder, referred to as "accident region") in which the operation performance worsens.

SUMMARY OF THE INVENTION

An object of the invention is to provide a fuel supply apparatus of an engine which is provided with an accident diagnosis apparatus of a fuel pressure control systems which is able to detect such an accident as reaches the above-mentioned accident region and to minimize the probability of erroneous judgement.

One feature of the present invention is that an accident in the fuel pressure control systems is judged by detecting breakage of a relation between a fuel pressure value and driving duty of a variable fuel pressure regulator.

Another feature of the present invention is that a time for which the pressure of fuel reaches an accident region is set under the condition that feedback control of fuel pressure is effected, and accident judgement of the fuel control systems is effected by obtaining occurrence of change in the pressure of fuel change for a predetermined time period or longer within the set time.

According to the present invention, concretely, the following apparatus is provided.

A fuel supply apparatus of an engine comprises a low pressure pump and a high pressure pump each for pressurizing and delivering fuel to be injected by injectors of the engine of direct injection type, a fuel pressure sensor for detecting fuel pressure, a variable fuel pressure regulator for controlling the fuel pressure, an operational state detecting means for detecting an operational state of the engine, a fuel pressure setting means for setting a target fuel pressure according to the operational state and a variable fuel pressure regulator driving means for driving the variable fuel pressure regulator to attain the target fuel pressure, wherein the fuel supply apparatus, at least, comprises an accident judging means for judging an accident by that a relation between the fuel pressure value used for fuel feedback control by the variable fuel pressure regulator driving means and driving duty by the variable fuel pressure regulator driving means is beyond an upper or lower limit value for a predetermined period of time.

A fuel supply apparatus of an engine comprises a low pressure pump and a high pressure pump each for pressurizing and delivering fuel to be injected by an injector of the engine of direct injection type, a fuel pressure sensor for detecting fuel pressure, a variable fuel pressure regulator for controlling the fuel pressure, an operational state detecting means for detecting an operational state of the engine, a fuel pressure setting means for setting a target fuel pressure according to the operational state and a variable fuel pressure regulator driving means for driving said variable fuel pressure regulator to attain the target fuel pressure, wherein the fuel supply apparatus, at least, comprises an accident judging means for judging a fuel control system by the conditions that the variable fuel pressure regulator driving means is effecting feedback control of the fuel pressure, that the pressure of fuel changes and that the change continues for a predetermined time of period within a set time range.

In an aspect of the present invention, the change in fuel pressure is judged by whether or not the fuel pressure by the fuel pressure sensor goes beyond the target fuel pressure by a predetermined value.

Further, the change in fuel pressure is judged by a change width of fuel pressure which is a fuel pressure change rate.

The change in fuel pressure is judged by whether or not an integrated fuel pressure value obtained by integration of fuel pressure values goes beyond a predetermined value.

The change in fuel pressure is judged by obtaining a relation between the target fuel pressure and driving duty of the variable fuel pressure regulator driving means.

The change in fuel pressure is judged by setting the fuel pressure value and by the set judgment fuel pressure value.

"Within the above-mentioned set time range" can be "within 1000 ms".

DESCRIPTION OF EMBODIMENTS OF THE INVENTION

Figure 1:
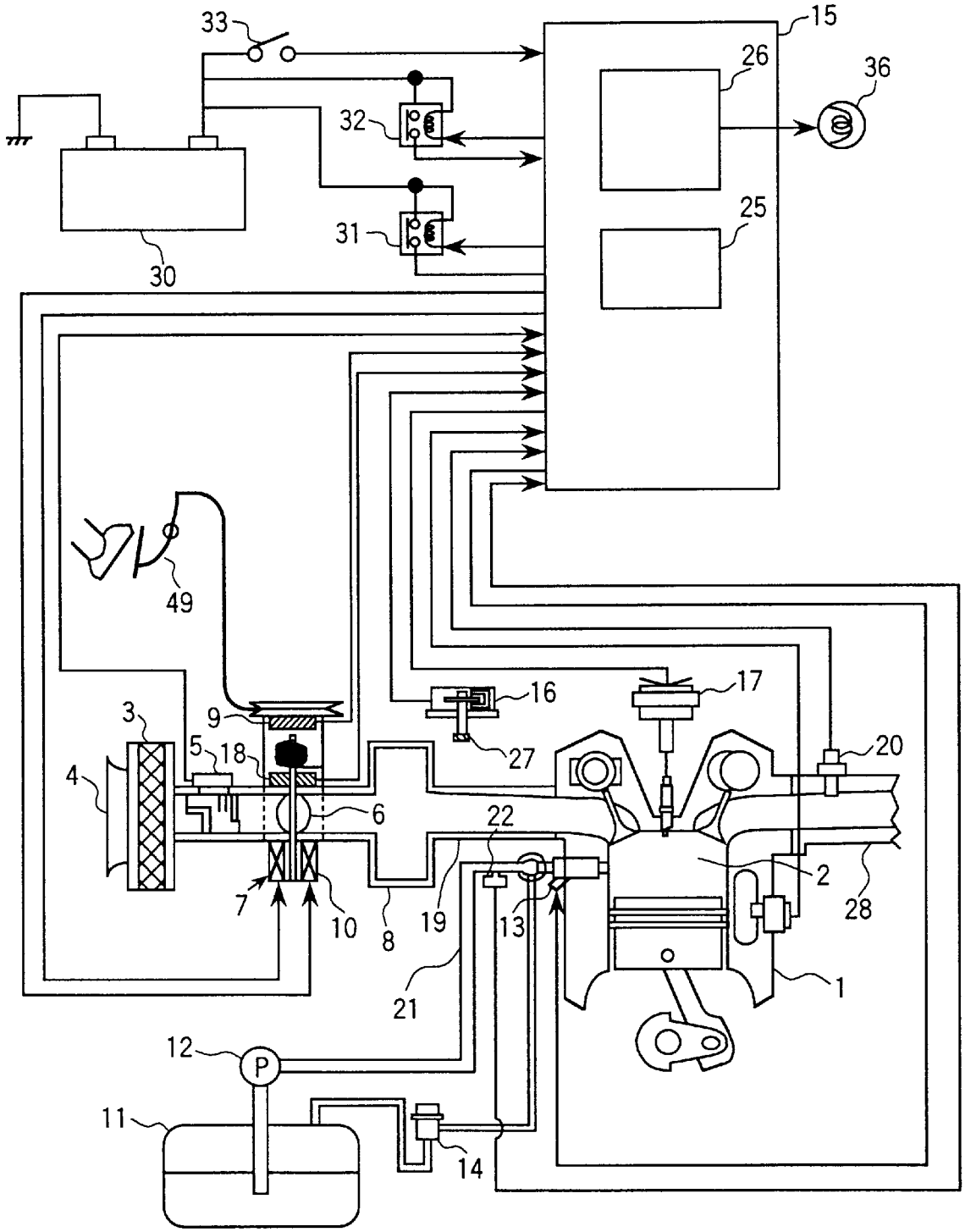
FIG. 1 is a schematic diagram of the whole engine system of an embodiment of the present invention.

Embodiments of the present invention will be described hereunder, referring to the drawings.

FIG. 1 shows an example of an engine system to which the present invention is applied. In FIG. 1, air to be sucked in by an engine 1 is taken at an inlet portion 4 of an air cleaner 3, passes through a throttle device 7 in which a throttle valve 6 is mounted for controlling a suction air quantity, and then enters a collector 8. The throttle valve 6 is connected to a motor 10 and operated by driving the motor 10. A suction air quantity is controlled by operation of the throttle valve 6. The suction air which reached the collector 8 is distributed to intake air pipes 19 which are connected to cylinders 2 of the engine, respectively, and then led to the cylinders 2.

On the other hand, fuel such as gasoline is sucked from a fuel tank 11 by a fuel pump 12 and raised in pressure, and then supplied to a fuel line 21 in which fuel injection valves (injectors) 13, a variable fuel pressure regulator 14 and a fuel pressure sensor 22 downstream of the fuel injector 13 are arranged. The fuel system includes the fuel tank 11, pump 12, fuel regulator 14, fuel pressure sensor 22, etc. Signals from the fuel pressure sensor 22 are input into the control unit 15. In the fuel system, the fuel is adjusted to a predetermined pressure by the above-mentioned variable fuel pressure regulator 14, and injected from the injectors 13 which have fuel injection ports opened to the cylinders 2, respectively. Further, an air flow meter 5 outputs signals representative of intake air quantities and the signals are input into a control unit 15.

Further, the throttle device 7 has a throttle sensor 18 mounted thereon and output of the throttle sensor 18 are also input into the control unit 15.

There is provided a crank angle sensor 16. The crank angle sensor 16 is driven to rotate by a cam shaft 27 and outputs signals representative of rotational position of the crankshaft. The signals are also input into the control unit 15.

An A/F (air fuel ratio) sensor 20 is provided on an exhaust pipe 28, detects air fuel ratios in a real operation from the compositions of exhaust gas and outputs signals thereof. The signals are input into the control unit 15.

An acceleration sensor 9 is integrated into the throttle device 7 as one body and connected to an accelerator 49. The acceleration sensor 9 detects an amount of operation of the accelerator 49 by a driver and outputs signals thereof. The signals are input into the control unit 15.

The control unit 15 has a processing means 26, takes in, as input signals, signals from various sensors detecting engine operational states such as the above-mentioned crank angle signals, accelerator opening signals, etc., and executes predetermined calculation to output various signals as the calculation results. Predetermined control signals are output from the control unit 15 to the above-mentioned fuel injectors 13, an ignition coil 17 and the motor 10 for throttle valve operation to execute fuel supply control, ignition timing control and suction air flow quantity control.

Between an electric source (battery) 30 and the control unit 15, a motor driver rely 31, a control unit rely 32 and an ignition switch relay 33 are provided. 35 denotes various alarm lights.

Those constructions are known, so that further detailed explanation is unnecessary.

Figure 2:
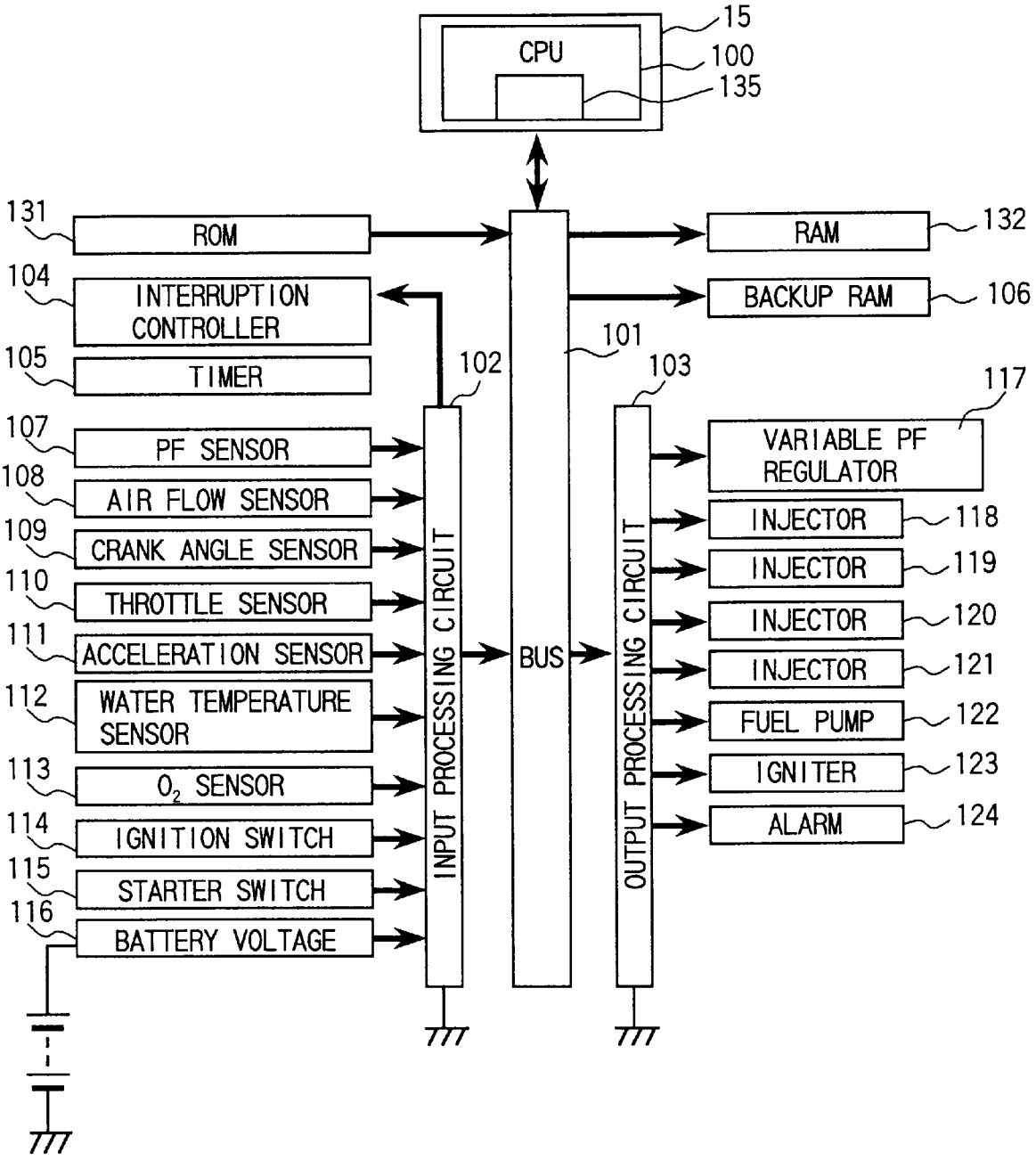
FIG. 2. is a block diagram of an engine fuel supply control apparatus.
Figure 4:
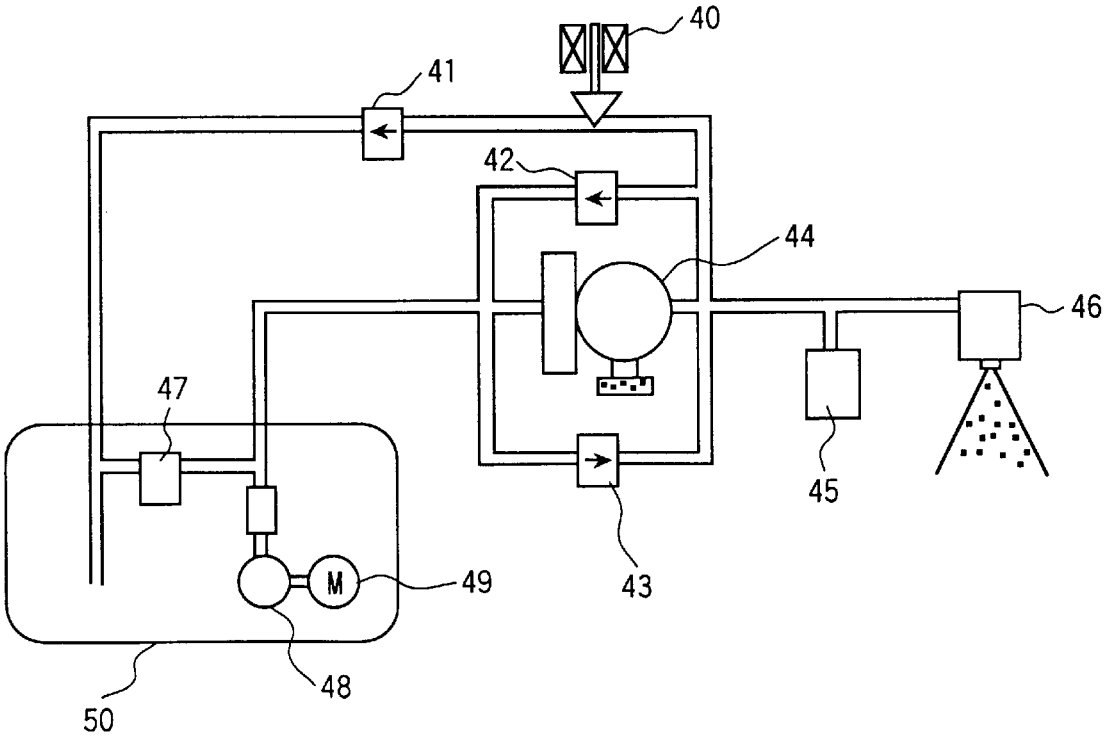
FIG. 4 is a schematic diagram of an engine fuel supply apparatus provided with a fuel control systems.

FIG. 2 shows an engine fuel supply control apparatus which can be applied to the fuel supply system of FIG. 1, FIG. 4, or the like.

A processor (CPU) 100 (shown by reference number 26 in FIG. 1) inside the control unit 15 is connected to a bus 101 to which an input processing circuit 102 and an output processing circuit 103 are connected. Signals are input into the input processing circuit 102 from fuel pressure sensor 107 (shown by 22 in FIG. 1 and 45 in FIG. 4), air flow sensor 108 (shown by 5 in FIG. 1), crank angle sensor 109 (shown by 16 in FIG. 1), throttle sensor 110 (shown by 18 in FIG. 1), acceleration sensor 111 (shown by 18 in FIG. 1), water temperature sensor 112, $O_2$ sensor 113, ignition switch 114 (shown by 33 in FIG. 1), starter switch 115 and battery voltage 116. Processed signals from the input processing circuit 102 are input into the bus 101 and an interrupt controller 104. A necessary time is measured by a timer 105. Output signals from the output circuit 103 are input into variable pressure regulator 117 (shown by 14 in FIG. 1; 40 in FIG. 4), injectors 118 to 121 (shown by 13 in FIG. 1; 46 in FIG. 4), fuel pump 122 (shown by 12 in FIG. 1; 48, 44 in FIG. 4), igniter 123 and alarm 124 (shown by 35 in FIG. 1). Signals recorded in a ROM 131 are input into the bus 101, and signals from the bus 101 are input to a RAM 132 and a backup RAM 106 to be recorded. The CPU 100 includes an accident judgement means 135 described later.

Figure 3:
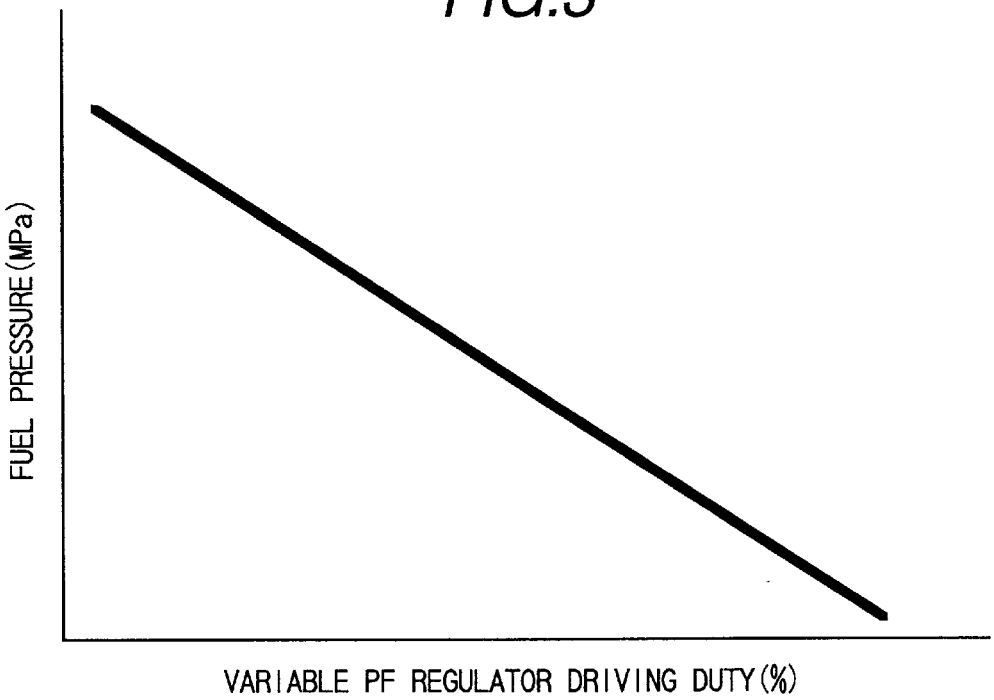
FIG. 3 is a diagram showing a relation between fuel pressure and driving duty of a variable fuel pressure regulator.

FIG. 3 shows a relation between fuel pressure (MPa) and driving duty (%) of the variable fuel pressure regulator (14, 44).

FIG. 4 shows another example of the fuel supply system which is suitable for direct injection engines, for example. Fuel from a fuel tank 50 is delivered to a high pressure pump 44 by a low pressure pump 48 to be raised in pressure and then delivered to an injector 46 to be injected. The low pressure pump 48 is driven by a motor 49. Check valves 42, 43 are mounted on piping connecting an input side and an output side of the high pressure pump 44. In this system, a fuel pressure sensor 45 is provided on piping connecting the high pressure pump 44 and the injector 46, and a variable fuel pressure regulator 40 and a check valve 41 are provided on piping connecting the output side of the high pressure pump 44 and the fuel tank 50.

Further, a low pressure regulator 47 is provided on piping connecting the high pressure pump 44 and the fuel tank 50.

Figure 5:
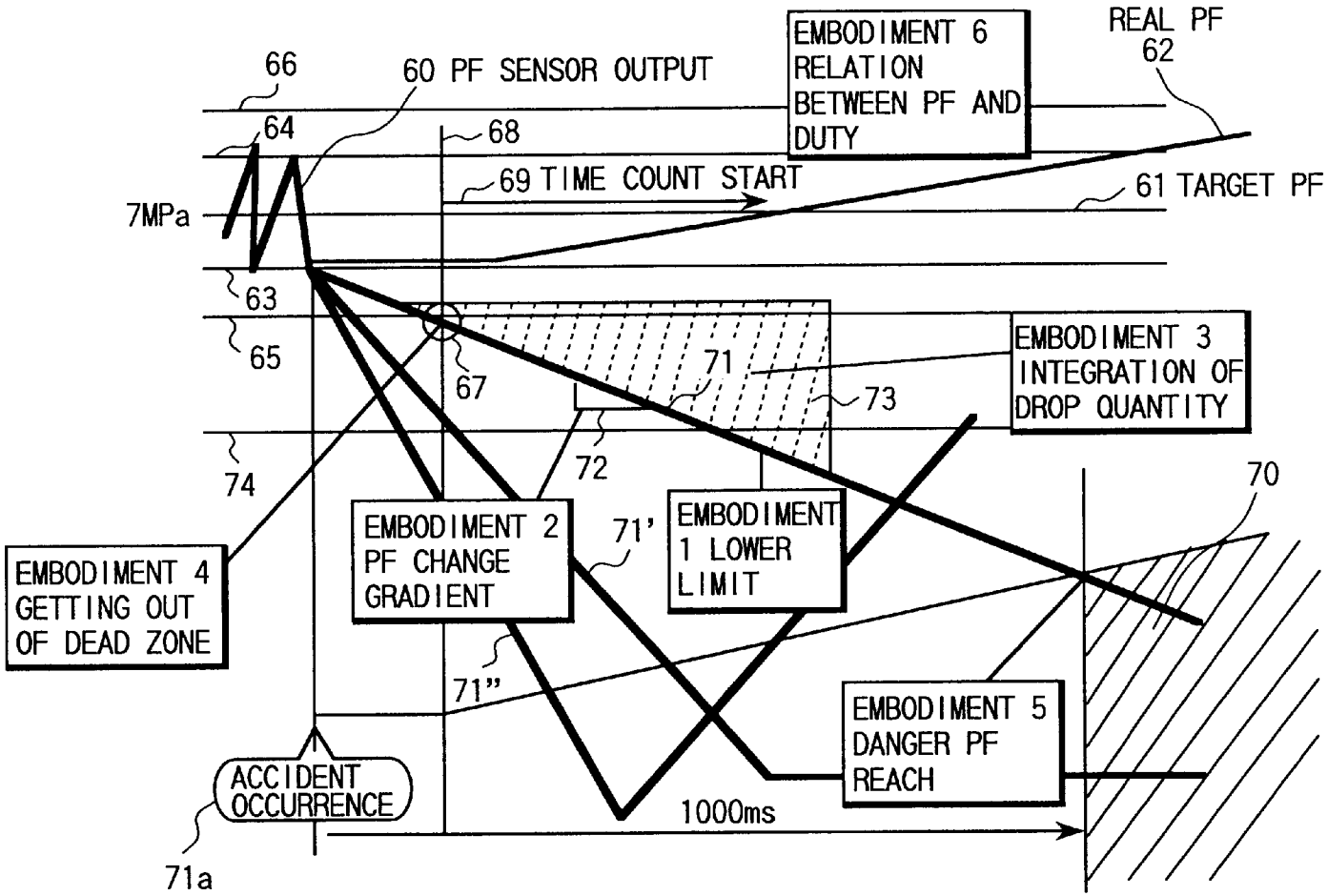
FIG. 5 is illustration showing embodiments.

FIG. 5 shows various solving means.

Embodiment 1

In FIG. 5, this embodiment is explained using a line 71 (or 71').

A target fuel pressure is set for the fuel supply system. The target fuel pressure is 7 MPa, for example, as shown by a target fuel pressure line 61. With respect to the target fuel pressure, a fuel pressure feedback dead zone, in which the feedback control is not effected irrespective of under the fuel pressure feedback control, is set. The fuel pressure feedback dead zone is defined by fuel pressure F/B dead zone lines 63, 64 which are formed by adding ±1 MPa to the target fuel pressure line 61. Further an accident judgment dead zone is set outside the fuel pressure feedback dead zone and defined by accident judgement dead zone lines 65, 66.

The variable fuel pressure regulator 14, 40 is subjected to fuel pressure feedback control, aiming at the target fuel pressure 61 as shown by the fuel pressure sensor output 60. Under this condition, when an accident occurs as shown by reference number 71*a*, the output drops as shown by the fuel pressure sensor output line 71, 71' or the like. In this case, fuel pressure control system accident judgment is effected by detecting that fuel pressure decreases below the accident judgment dead zone lower limit line 65. That is, an accident is judged to occur when the fuel pressure goes beyond the accident judgement dead zone lower limit line 65. Accident judgement in a case of an upper limit is also done in a similar manner to the case of the lower limit. In the case as shown by a line 71", there is a fear that abnormality may be judged as normality by erroneous judgement due to rebounding. In this case, it is important that from a viewpoint of reliability of the fuel pressure sensor 22, 45, such control as energize the alarm is not effected immediately after the fuel pressure goes beyond the fuel pressure F/B dead zone lower limit line 63, but fuel pressure F/B control is started.

When an accident level of the fuel pressure sensor is to be set 50% down of a real fuel pressure, that is, when the maximum accident fuel pressure is made to be 50% down of a real fuel pressure line 62, a so-called accident reaching time until the operability is worsened can be set 1000 ms. If the conditions that the fuel pressure is 50% or less continues for 1000 ms for example, the operation performance is worsened, which is shown by reference number 70. Accident judgement of the fuel pressure control system including the fuel pressure sensor 22 is effected by detecting that the fuel pressure is below the accident judgement dead zone lower limit line 65 and detecting that time counted from a time count start line 68 passing a cross point 67 of the fuel pressure sensor output line 71 and the accident judgement dead zone lower limit line 65, as shown by a time count start line 69 has passed for a predetermined time or more within the accident reaching time and a shortest time which is allowable to be set for accident diagnosis without erroneous judgement.

Figure 6:
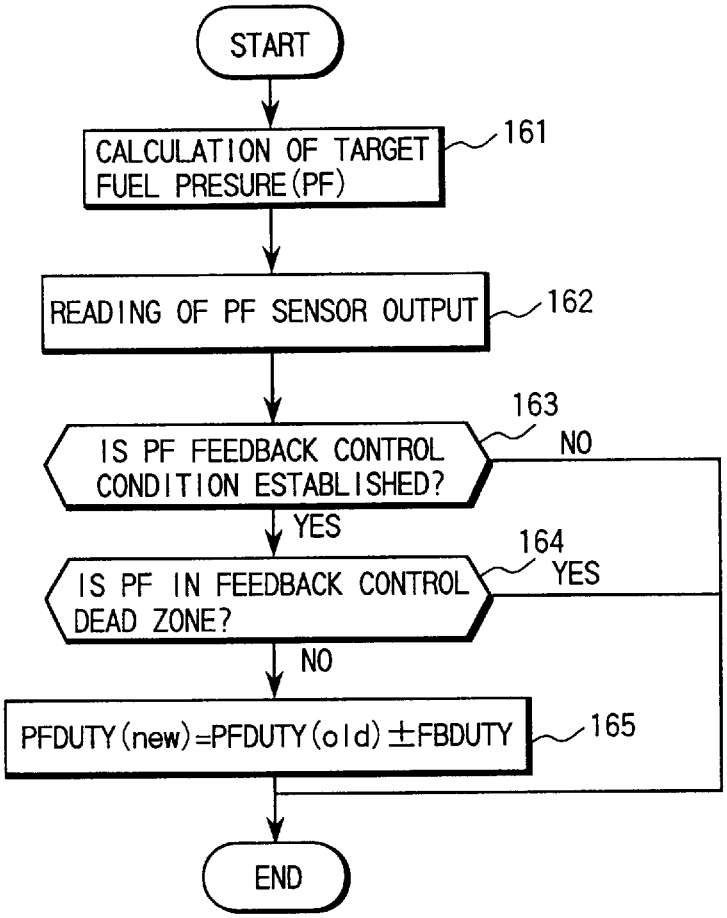
FIG. 6 is a flow chart.
Figure 7:
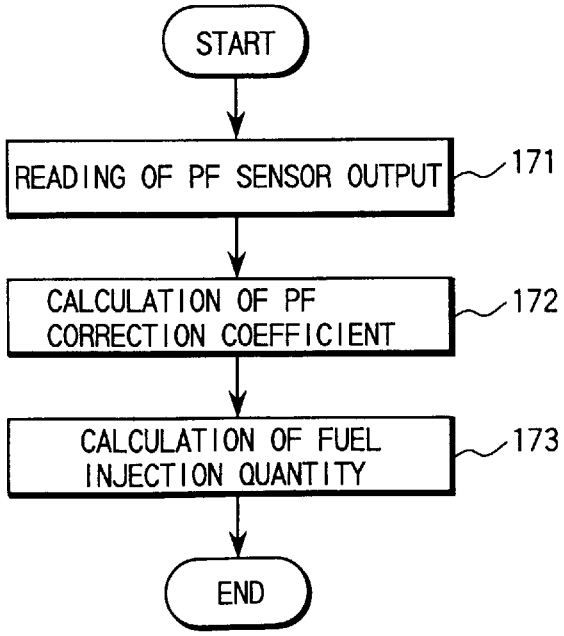
FIG. 7 is a flow chart.

FIG. 6 and FIG. 7 show flow charts of fuel pressure feedback control and fuel injection during normal operation. FIG. 6 shows a target fuel pressure calculation step 161, a fuel pressure sensor output reading step 162, a step 163 of judging whether or not a fuel pressure feedback condition is established, a judgement step 164 of judging whether or not the fuel pressure is within feedback control dead zone when the fuel pressure feedback condition is established, and a step 165 of effecting feedback control according to PFDUTY(new)=PFDUTY(old)±FBDUTY, wherein PFDUTY(new) expresses control duty by the variable fuel pressure regulator, PFDUTY(old) denotes the last control duty and ±FBDUTY denotes the duty to be fed back. Further as shown in FIG. 7, fuel injection control is effected in which a fuel pressure reading step 171, a fuel pressure correction coefficient calculation step 172 and a fuel injection quantity calculation step 173 are executed.

The above-mentioned judgement control is executed under the above-mentioned fuel pressure feedback control. The accident judgement means judges whether or not the fuel pressure sensor output line reaches the accident level and a predetermined time or more is passed, a notice is sent to the alarm when the judgement is diagnosed to be an accident and such an action as notices the danger to person on the vehicle is taken.

Embodiment 2

In FIG. 5, this embodiment is constructed by taking a fuel pressure inclination 72 of the line 71.

In this embodiment, a fuel pressure change width (fuel pressure change rate) in a predetermined time is detected, thereby to effect fuel pressure control system accident judgement. That is, ΔAVEPF which is a fuel pressure drop per a time Δt is calculated, the calculated value is used for accident judgement. Judgement whether or not the calculated value reaches an accident level region 70 is done in the same manner as in the embodiment 1, so that it is not repeated here.

Figure 8:
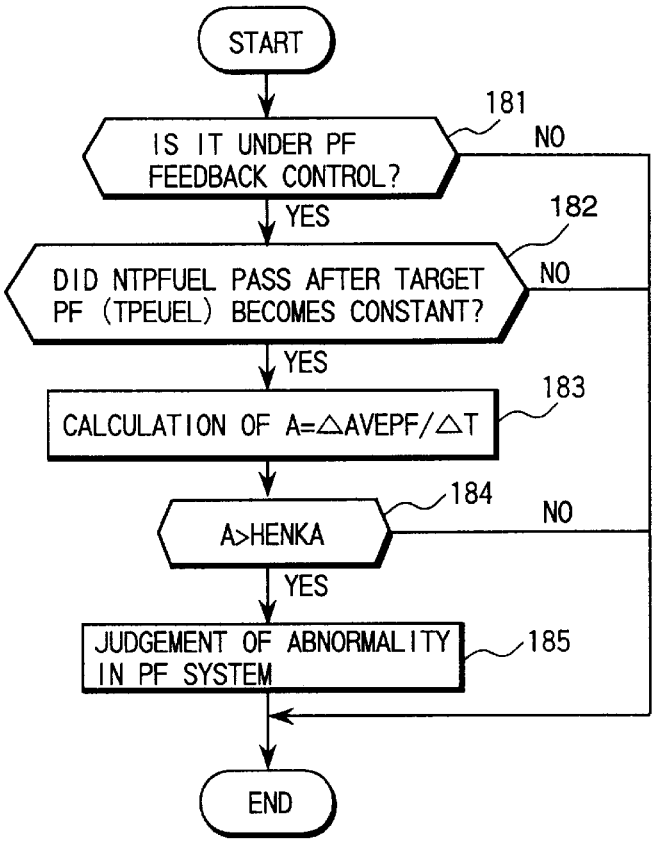
FIG. 8 is a flow chart.

FIG. 8 shows a flow chart in this case. As shown in FIG. 8, the operation is composed of the following steps. At step 181, judging whether or not the operation is during fuel pressure feedback control is effected. If it is under fuel pressure feedback control, judging whether NTPFUEL (predetermined time) has passed after the target fuel pressure TPFUEL becomes constant is effected at step 182. If the predetermined time has passed, calculating A=Δ AVEPF/Δt is carried out at step 183. At step 184, whether A>HENKA (a predetermined fuel pressure change speed) is viewed, and if yes, the fuel pressure system is judged to be abnormal at step 185.

Embodiment 3

In FIG. 5, this embodiment judges an accident by using a product Δt×(fuel pressure difference between a target fuel pressure and a real fuel pressure) of line. That is, when the fuel pressure value is below the target fuel pressure by a predetermined value or more, difference in fuel pressure value is integrated with respect to time, and a fuel control system accident is judged by detecting that the integrated value (time×fuel pressure difference) 73 becomes more than a predetermined value. The judgement of whether or not it reaches an accident level region 70 is effected in the same manner as in the embodiment 1, so that it is not repeated here.

Figure 9:
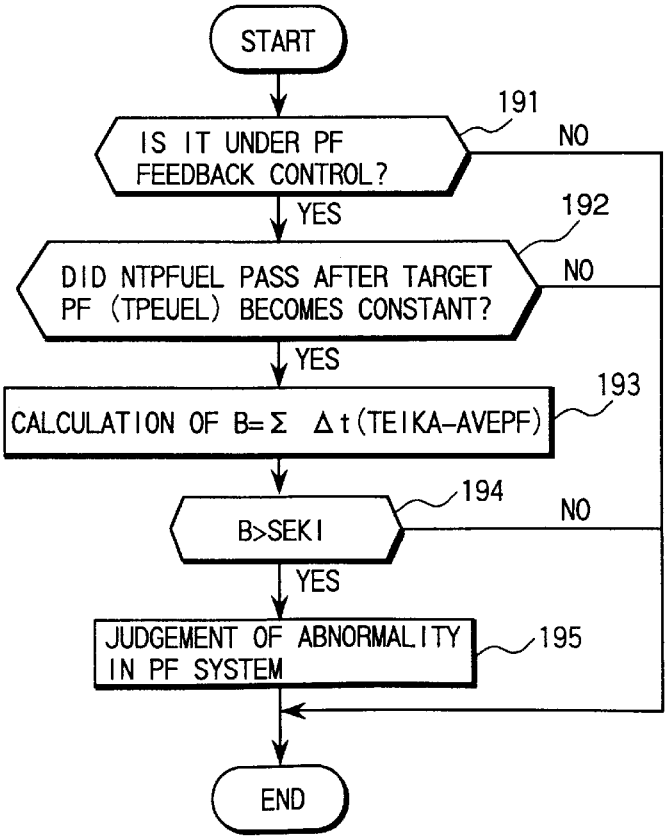
FIG. 9 is a flow chart.

FIG. 9 shows a flow chart in this case. As shown in FIG. 9, the operation is composed of a step 191 of judging whether or not the operation is during fuel pressure feedback control, a step 192 of judging whether NTPFUEL has been passed after the target fuel pressure TPFUEL becomes constant, a step 193 of calculating an integrated value B=ΣΔt(TEIKA−AVEPF) in which TEIKA is a target fuel pressure and AVEPF is a fuel pressure drop from the target fuel pressure, a step 194 of viewing B>SEKI (a predetermined value) and a fuel pressure control system abnormality judgement step 195 in which the fuel pressure control system is judged to be abnormal when the integrated value B is larger than SEKI.

Embodiment 4

In FIG. 5, this embodiment judges an accident by a time reaching a danger fuel pressure line 74 from PF<F/B dead zone.

This is to secure a margin for the real accident level in order to make the real fuel pressure into a high pressure and it is to set a fuel pressure change speed lower limit value. According to this embodiment, since a time required for abnormality detection is short, it is possible to rapidly detect the abnormality.

Figure 10:
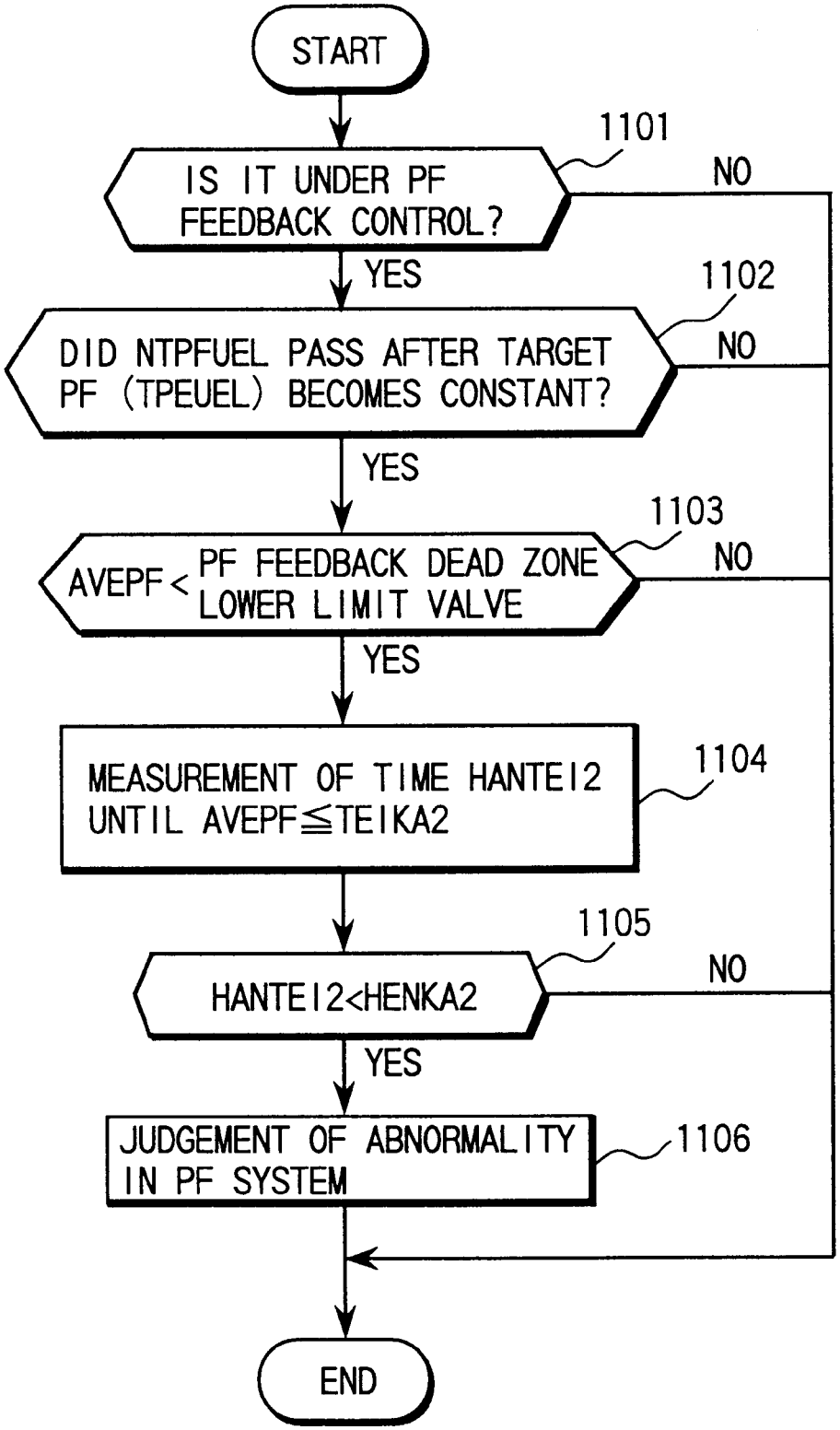
FIG. 10 is a flow chart.

A flow chart in this case is shown in FIG. 10. The operation is composed of a step 1101 of judging whether or not the operation is during fuel pressure feedback control, a step 1102 of judging whether NTPFUEL has been passed after the target fuel pressure TPFUEL becomes constant, a step 1103 of viewing whether a fuel pressure drop AVEPF is less than a fuel pressure feedback dead zone lower limit value, a step 1104 of measuring, when less, a time HANTEI2 required until the fuel pressure drop AVEPF becomes equal to or less than a predetermined value, that is, until AVEPF≦TEIKA2 is established, a step 1105 of viewing whether the time HANTEI2 is less than a predetermined value HENKA2, and a fuel pressure system abnormality judgement step 1106 in which the fuel pressure system is judged to be abnormal when HANTEI 2<HENKA 2.

Embodiment 5

In FIG. 5, this embodiment is to judge an accident by a time of PF<a predetermined value (danger fuel pressure).

In this embodiment, an accident is judged when the detected fuel pressure is lower than a judgement fuel pressure for a predetermined time within a time required for reaching an accident level region 70 from set judgement fuel pressure. A margin for raising fuel pressure higher by fuel pressure F/B is secured for a danger fuel pressure line 74, and a margin for providing a judgement delay time (fixed) is secured. In order to distinguish it from such instantaneous fuel pressure input behavior that an accident does not occurs thereby, about 50 ms is set as the judgement delay time, for example.

Figure 11:
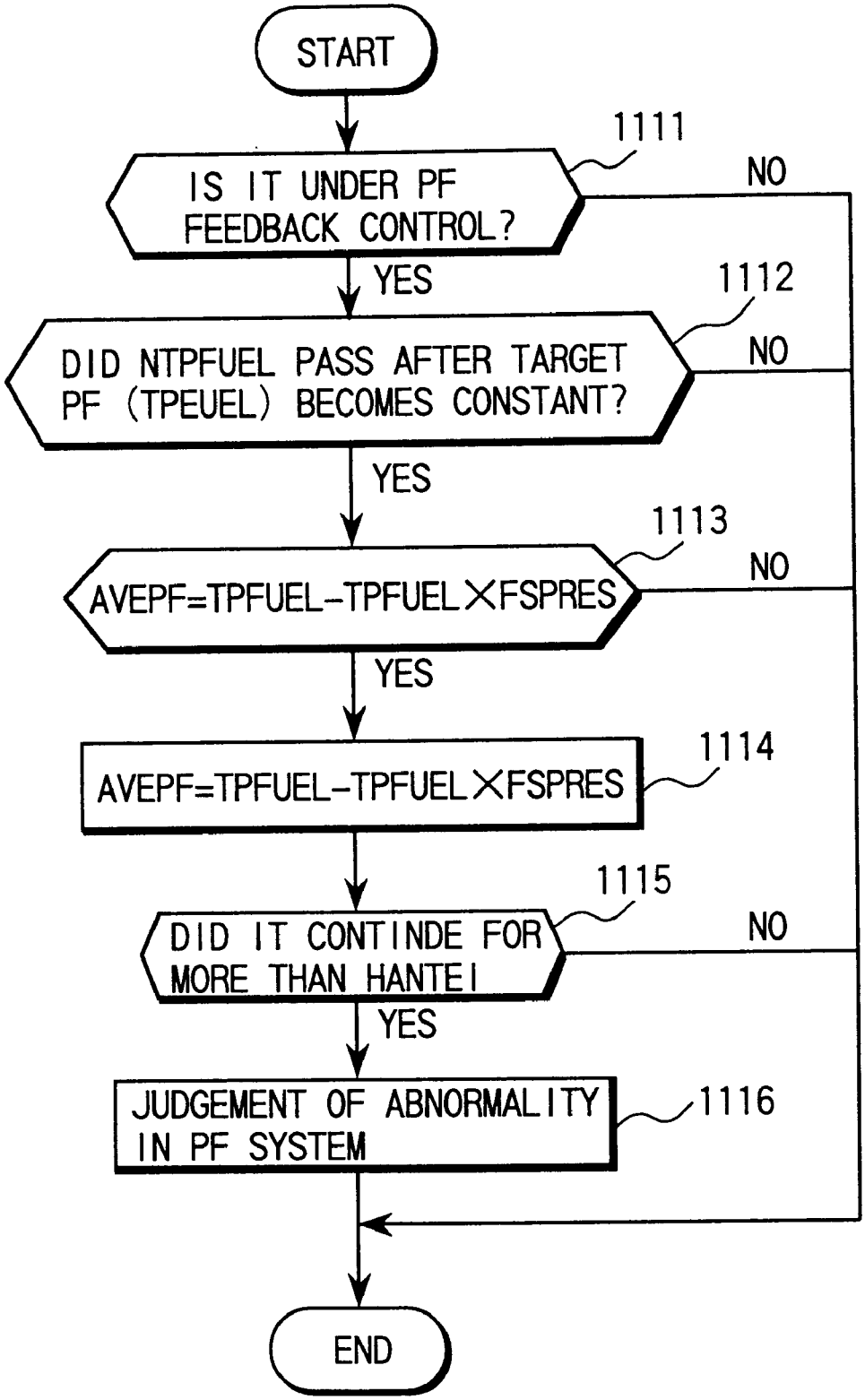
FIG. 11 is a flow chart.

A flow chart in this case is shown in FIG. 11. The operation composed of a step 1111 of judging whether or not the operation is during fuel pressure feedback control, a step 1112 of judging whether NTPFUEL has been passed after the target fuel pressure TPFUEL becomes constant, a step 1113 of viewing whether a detected fuel pressure value AVEPF≦TPFUEL (target fuel pressure)−TPFUEL× FSPRES in which FSPRES is a predetermined value or ratio such as coefficient by which the fuel pressure sensor can be allowed to detect a fuel pressure less than a real value, a step 1114 of calculating a fuel pressure AVEPE' from the equation AVEPE'=TPFUEL−TPFUEL×FSPRES when AVEPF≦TPFUEL−TPFUEL×FSPRES, a step 1115 of viewing whether it continue for more than HANTEI (predetermined time), and a fuel pressure control system abnormality judgement step 1116 in which fuel pressure control system is judged to be abnormal when the fuel pressure AVEPF' is kept for more than HANTEI.

Embodiment 6

The embodiment 6 is to judge abnormality in the control system from a relation between fuel pressure and duty. That is, an accident in the fuel pressure control system is judged by detecting breakage of the relation between the fuel pressure value and driving duty of the variable fuel pressure regulator.

Figure 12:
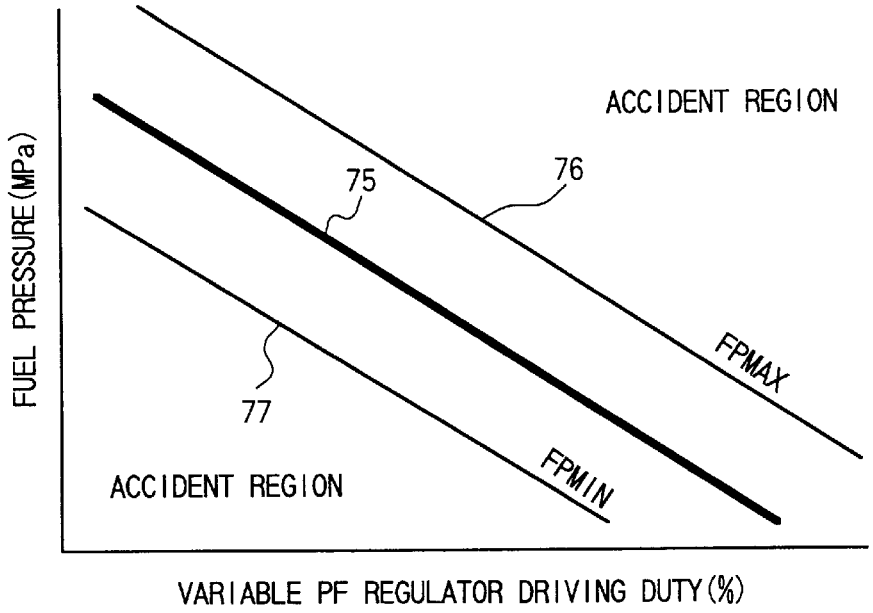
FIG. 12 is a diagram showing relations between fuel pressure and driving duty of a variable fuel pressure regulator, showing another embodiment of the present invention.

FIG. 12 shows a relation between fuel pressure (MPa) and driving duty (%) of the variable fuel pressure regulator. An upper side limit value line FPMAX 76 is provided at the upper side of a normal relation value line 75 between fuel pressure and driving duty of the variable fuel pressure regulator, and a lower side limit value line FPMIN 77 is set at the lower side of the normal relation line 75. An accident is judged by entrance of the fuel pressure into an accident region when the relations are broken and the fuel pressure goes beyond any of the limit value lines.

This fuel pressure control system accident judgement is effected by judging continuation of breakage of the relation between fuel pressure and driving duty of the variable fuel pressure regulator for a predetermined time or more, as in the embodiment 1.

Figure 13:
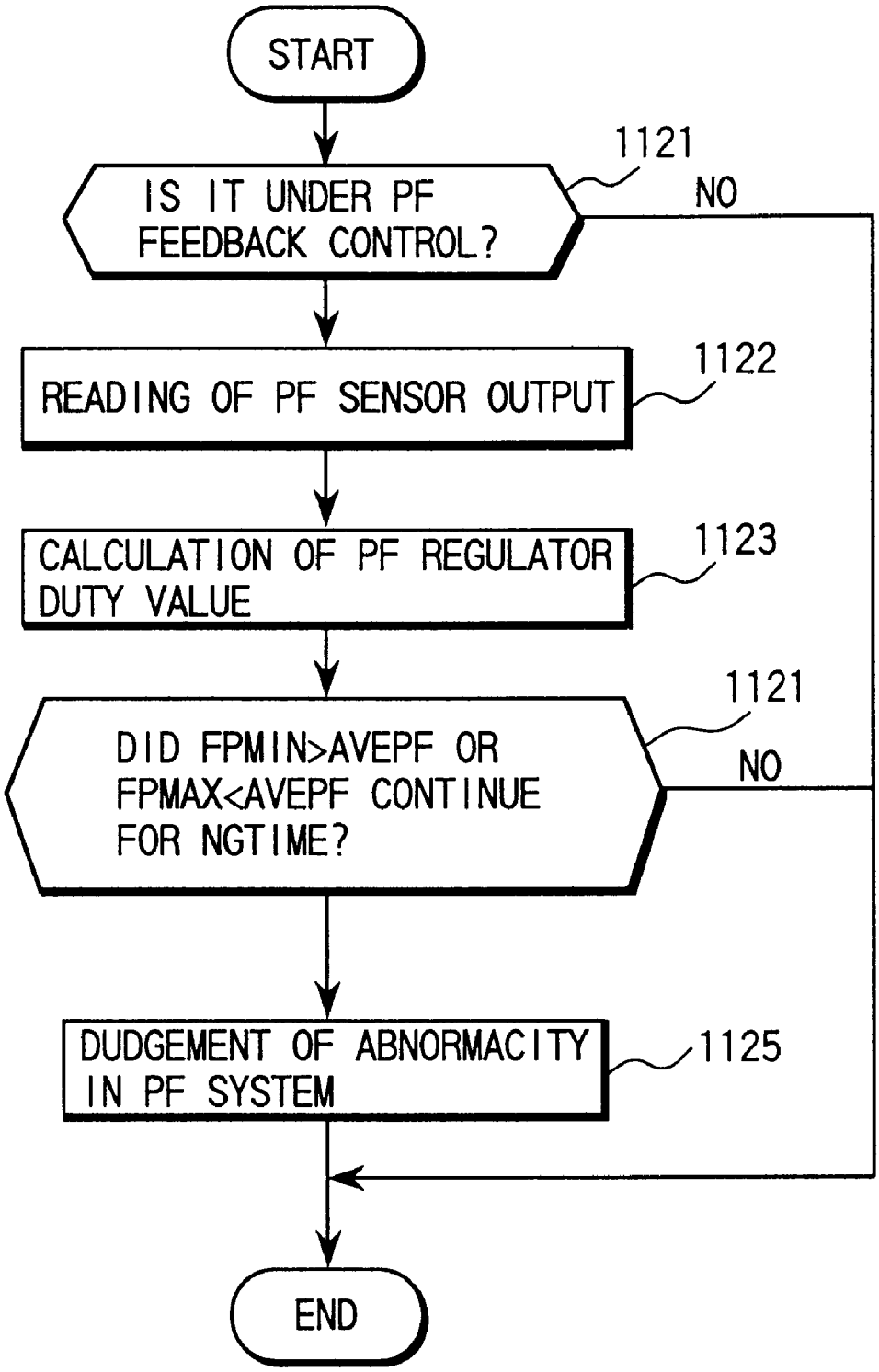
FIG. 13 is a flow chart.

FIG. 13 shows a flow chart in this case.

The operation is composed of a step 1121 of judging whether or not the operation is during fuel pressure feedback control, a step 1122 of reading output of the fuel pressure sensor, a step 1123 of calculation of duty of the fuel pressure regulator, a step 1124 of viewing continuation of FPMIN>AVEPF or FPMAX<AVEPF for NGTIME (predetermined time) and a step 1125 of judging abnormality of the fuel pressure system by the result.

Figure 14:
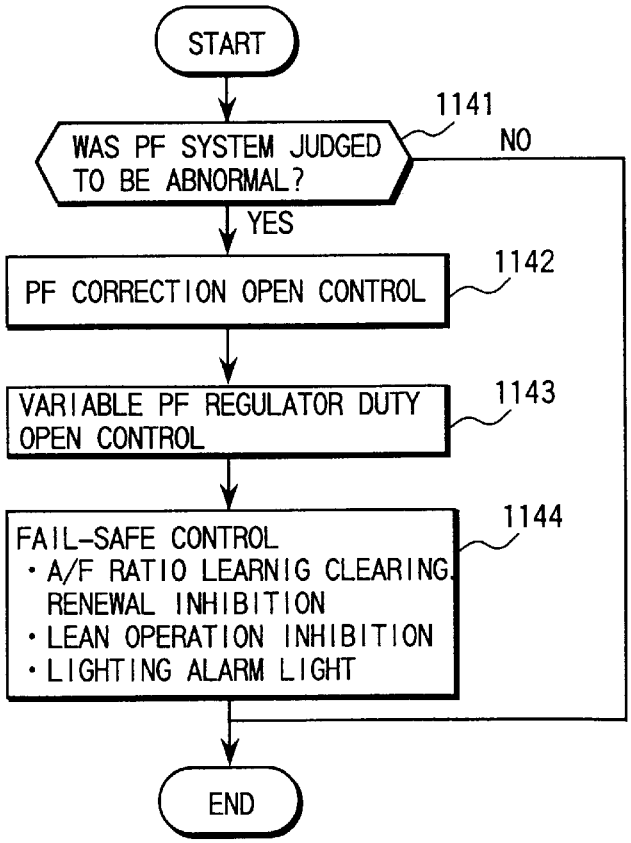
FIG. 14 is a flow chart for fail-safe control.

FIG. 14 is a flow chart showing measures to be taken when the fuel pressure control system was judged to be abnormal.

When the fuel pressure control system is judged to be abnormal at a step 1141 of fuel pressure control system abnormality judgement, the operation is switched to fuel pressure correction open control at step 1142, the variable fuel pressure regulator is switched to variable fuel pressure regulator duty open control at step 1143, and then fail-safe control is effected at step 1144. Here, air fuel ratio learning is cleared, that is, an on-board control result of air fuel ratio is initialized, and renewal is inhibited. Further, lean operation is exhibited, the alarm raises an alarm, for example, an alarm light is lighted on.

According to the present invention, accident judgement of the fuel pressure control system can be effected before reaching an accident level, as mentioned above, additionally, the judgement is effected under the condition of accident detection of a predetermined time within a time of period from a time at which the fuel pressure sensor goes out of the dead zone to a time at which the pressure sensor reach the accident level, so that accident judgement of the fuel pressure control system can be effected with very less erroneous judgement.

What is claimed is:

1. A fuel supply apparatus of an engine, comprising a low pressure pump and a high pressure pump each for pressurizing and delivering fuel to be injected by an injector of the engine of direct injection type, a fuel pressure sensor for detecting fuel pressure, a variable fuel pressure regulator for controlling the fuel pressure, and operational state detecting means for detecting an operational state of the engine, a fuel pressure setting means for setting a target fuel pressure according to the operational state and a variable fuel pressure regulator driving means for driving said variable fuel pressure regulator to get the target fuel pressure, wherein said fuel supply apparatus further comprises an accident judging means for judging an accident of said fuel supply apparatus by the relationship between the fuel pressure valve used for fuel feedback control by said variable fuel pressure regulator driving means and driving duty of said variable fuel pressure regulator driving means being outside an upper or lower limit value for a predetermined period of time.

2. A fuel supply apparatus of an engine according to claim 1, wherein the change in fuel pressure is judged by setting said fuel pressure value and on the basis of the set judgment fuel pressure value.

3. A fuel supply apparatus of an engine comprising a low pressure pump and a high pressure pump each for pressurizing and delivering fuel to be injected by an injector of the engine of direct injection type, a fuel pressure sensor for detecting fuel pressure, a variable fuel pressure regulator for controlling the fuel pressure, an operational state detecting means for detecting an operational state of the engine, a fuel pressure setting means for setting a target fuel pressure according to the operational state and a variable fuel pressure regulator driving means for driving said variable fuel pressure regulator to get the target fuel pressure, wherein said fuel supply apparatus, at least, comprises an accident judging means for judging a fuel control system by the conditions that said variable fuel pressure regulator driving means is effecting feedback control of the fuel pressure, and that there is a change in fuel pressure and the change continues for a predetermined time of period within a set time range.

4. A fuel supply apparatus of an engine according to claim 3, wherein the change in fuel pressure is judged by whether or not the fuel pressure by said fuel pressure sensor goes beyond said target fuel pressure by a predetermined value.

5. A fuel supply apparatus of an engine according to claim 3, wherein the change in fuel pressure is judged by a change width of fuel pressure which is a fuel pressure change rate.

6. A fuel supply apparatus of an engine according to claim 3, wherein the change in fuel pressure is judged by whether or not an integrated fuel pressure value obtained by integration of fuel pressure values goes beyond a predetermined value.

7. A fuel supply apparatus of an engine according to claim 3, wherein the change in fuel pressure is judged by obtaining a relation between said target fuel pressure and driving duty of said variable fuel pressure regulator driving means.

8. A method for judging an accident of an engine fuel supply apparatus, comprising a low pressure pump and a high pressure pump each for pressurizing and delivering fuel to be injected by an injector of an engine of direct injection type, a fuel pressure sensor for detecting fuel pressure, a variable fuel pressure regulator for controlling the fuel pressure, and operational state detecting means for detecting an operational state of the engine, a fuel pressure setting means for setting a target fuel pressure according to the operational state and a variable fuel pressure regulator driving means for driving said variable fuel pressure regulator to get the target fuel pressure, said method comprising:

setting the target fuel pressure for the fuel supply system;

setting fuel pressure feedback dead zone on the basis of the target fuel pressure;

setting an accident judgment dead zone outside the fuel pressure feedback dead zone;

controlling the pressure of fuel to be supplied to a fuel injector; and judging an accident to have occurred in the fuel supply system when the fuel pressure is outside said accident judgment dead zone for a predetermined time or more.

9. The method according to claim 8, further comprising starting feedback control of fuel pressure in the fuel supply system when the fuel pressure detected by the fuel pressure sensor goes beyond the accident judgment dead zone, and said predetermined time is counted from the starting of the feedback control.

10. A method of judging an accident of an engine fuel supply apparatus, comprising a low pressure pump and a high pressure pump each for pressurizing and delivering fuel to be injected by an injector of an engine of direct injection type, a fuel pressure sensor for detecting fuel pressure, a variable fuel pressure regulator for controlling the fuel pressure, an operational state detecting means for detecting an operational state of the engine, a fuel pressure setting means for setting a target fuel pressure according to the operational state and a variable fuel pressure regulator driving means for driving said variable fuel pressure regulator to get the target fuel pressure, said method comprising the steps:

detecting a condition that said variable fuel pressure regulator driving means is effecting feedback control of the fuel pressure to be supplied in a fuel injector;

detecting a change in fuel pressure and a time length;

counting a continuation time of the change in fuel pressure; and judging the fuel supply apparatus to be an accident when the change continues at a predetermined level or more for a predetermined time or more under the condition of the feedback control being effected.

* * * * *